US012601557B2

(12) United States Patent
D'Amato

(10) Patent No.: US 12,601,557 B2
(45) Date of Patent: Apr. 14, 2026

(54) QUICK COUPLING MUZZLE BOOSTER AND SURPRESSOR ADAPTOR SYSTEM FOR LOCKED BREECH PISTOLS AND PISTOL CALIBER CARBINES

(71) Applicant: John D'Amato, New Brighton, PA (US)

(72) Inventor: John D'Amato, New Brighton, PA (US)

( * ) Notice: Subject to any disclaimer, the term of this patent is extended or adjusted under 35 U.S.C. 154(b) by 97 days.

(21) Appl. No.: 18/120,885

(22) Filed: Mar. 13, 2023

(65) Prior Publication Data

US 2023/0288164 A1 Sep. 14, 2023

Related U.S. Application Data

(60) Provisional application No. 63/318,932, filed on Mar. 11, 2022.

(51) Int. Cl.
*F41A 21/32* (2006.01)

(52) U.S. Cl.
CPC ..... *F41A 21/325* (2013.01)

(58) Field of Classification Search
CPC ..... F41A 21/325
See application file for complete search history.

(56) References Cited

U.S. PATENT DOCUMENTS 4,893,426 A * 1/1990 Bixler ..... F16B 7/20 89/14.05
5,433,133 A * 7/1995 La France ..... F41A 21/325 89/14.2
5,559,302 A * 9/1996 Latka ..... F41A 21/325 89/14.05
8,997,621 B1 * 4/2015 Dater ..... F41A 21/325 89/14.3
9,175,919 B2 * 11/2015 Russell ..... F41A 21/30
9,513,078 B1 * 12/2016 Fulton ..... F41A 21/325
9,631,888 B2 * 4/2017 Young ..... F41A 21/325
10,184,744 B2 * 1/2019 Young ..... F41A 21/325
11,486,670 B1 * 11/2022 Lovas ..... F41A 21/325
2016/0102935 A1 * 4/2016 Young ..... F41A 21/325 42/76.01
2017/0167816 A1 * 6/2017 Young ..... F41A 21/325

* cited by examiner

*Primary Examiner* — Jonathan C Weber
(74) *Attorney, Agent, or Firm* — Blynn L. Shideler; Krisanne Shideler; BLK Law Group

(57) ABSTRACT

The present invention provides a quick coupling muzzle booster and suppressor adaptor system having a quick coupling muzzle booster and suppressor adaptor and direct rifle mount that can be coupled to a suppressor and mounted on a lock breech pistol or pistol caliber carbine. The system according to the invention provides wherein the quick coupling muzzle booster includes a booster slide with an external quick connect for coupling to the suppressor adaptor, and wherein the external quick connect of the booster slide includes a plurality of lugs corresponding to a proximal end of a housing of the suppressor coupling, and wherein the muzzle booster includes a booster piston that is coupled to a pistol. The system according to the invention may provide wherein the muzzle booster includes a booster piston nut with a spring, wherein the booster piston nut is coupled to the booster piston.

20 Claims, 2 Drawing Sheets

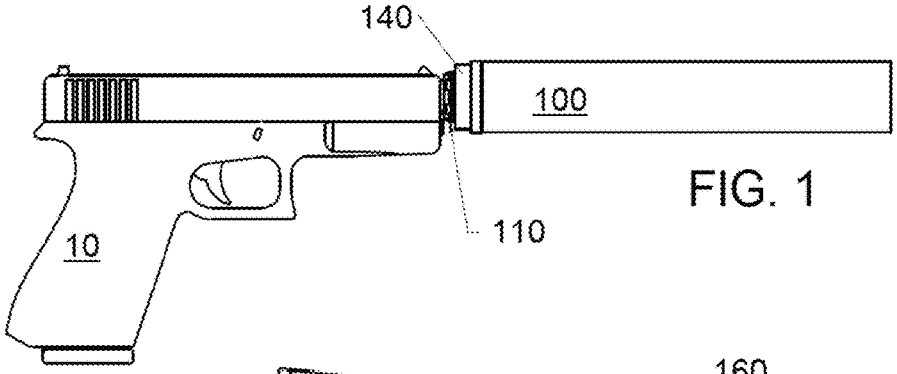
FIG. 1
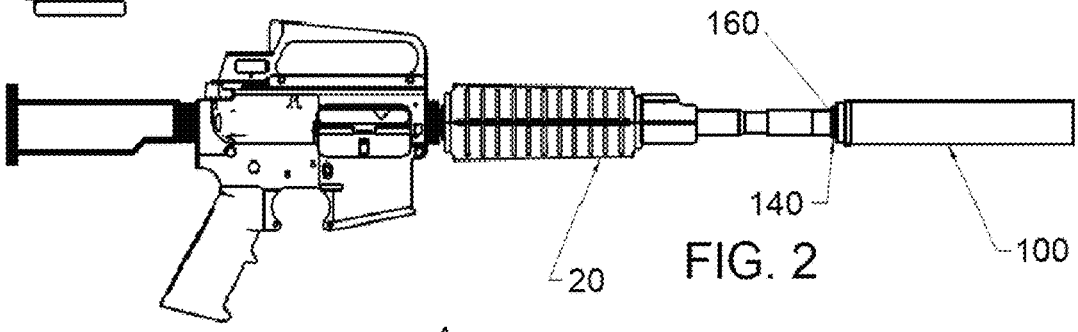
FIG. 2
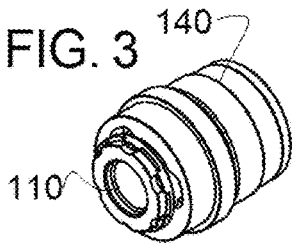
FIG. 3
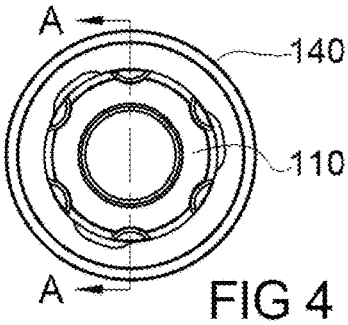
FIG 4
FIG. 5
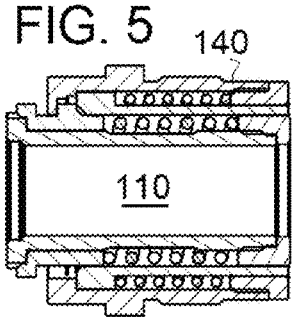
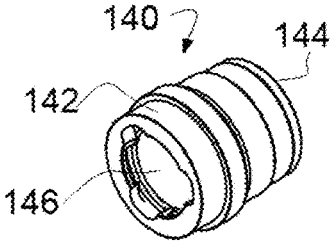
FIG. 6
FIG.7
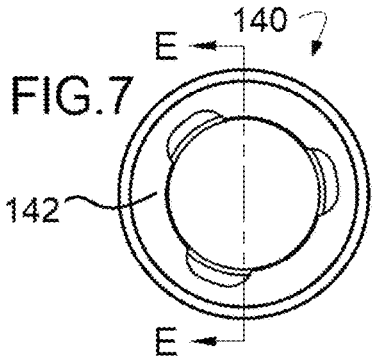
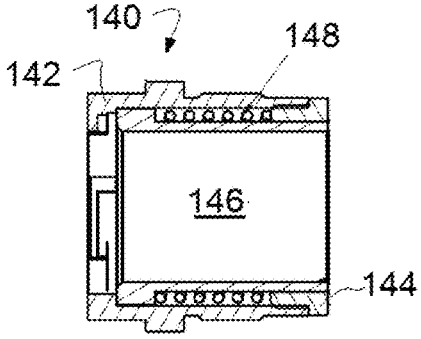
FIG. 8

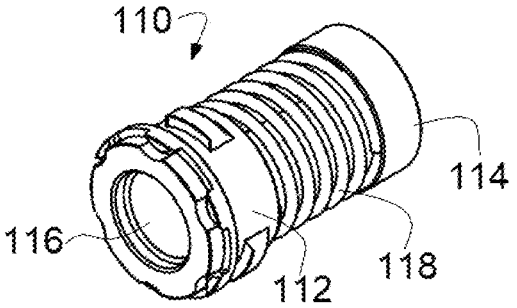
FIG. 9
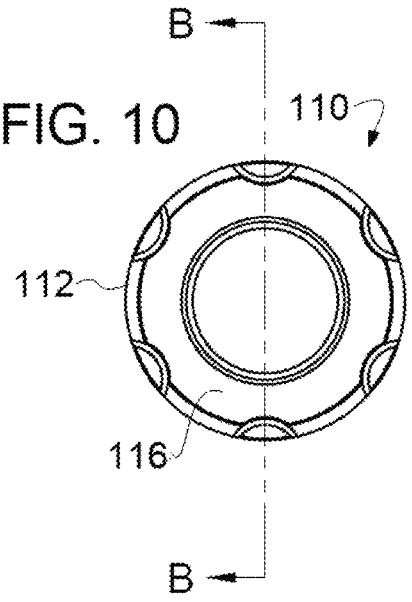
FIG. 10
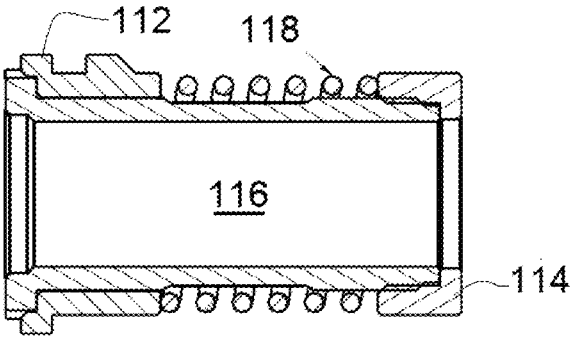
Fig. 11
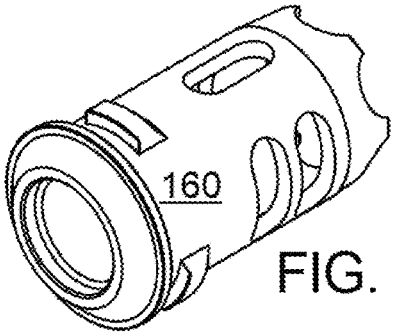
FIG. 12
FIG. 13
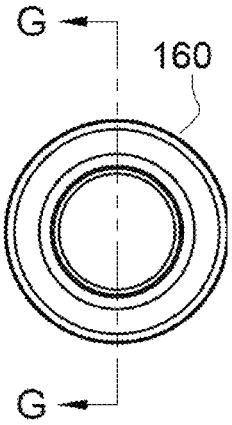
FIG. 14
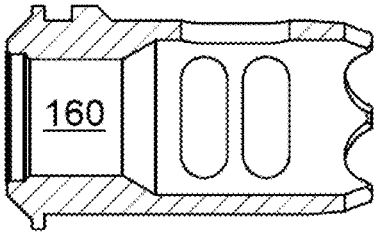

QUICK COUPLING MUZZLE BOOSTER AND SURPRESSOR ADAPTOR SYSTEM FOR LOCKED BREECH PISTOLS AND PISTOL CALIBER CARBINES

RELATED APPLICATIONS

This application claims the benefit of U.S. provisional patent application Ser. No. 63/318,932 filed Mar. 11, 2022 titled "Quick Coupling Muzzle Booster and Suppressor Adaptor System for Locked Breech Pistols and Pistol Caliber Carbines" which is incorporated herein by reference.

BACKGROUND OF THE INVENTION

1. Field of the Invention

This invention generally relates to muzzle boosters and suppressors for locked breech pistols and pistol caliber carbines.

2. Background Information

Most pistols made today are short recoil operated, also called locked-breech pistols. These guns can more easily handle higher pressure cartridges because when the slide starts moving to the rear, the barrel moves with it.

Suppressors, commonly referred to as "silencers," are devices fixed to the end of a firearm intended to muffle the sound of a shot being fired, not to silence the sound. The sound of a gunshot from a gun with a suppressor is still loud, but is generally safe enough for the operator to avoid having to wear hearing protection (with the exception of some large calibers firearms). Essentially, suppressors make guns just quiet enough to reduce most, or all, of the downsides associated with extremely loud gunshots. The suppressors, generally, have minimal impact on a bullets velocity and accuracy.

Reliable cycling of suppressed locked breech pistols, also called short recoil guns, with a wide range of ammunition has long been a problem. The addition of a suppressor to a locked breech short recoil firearm increases the mass of the system and prevents the firearm from cycling. The most common solution to this issue is a muzzle booster, also known as a recoil booster, a booster, or a Nielsen Device. The muzzle booster utilizes a spring to absorb the additional mass of the silencer and ensure the firearm cycles normally.

Traditionally, the muzzle booster housing retains the spring and piston and the booster housing is threaded on the outer diameter to screw directly into a silencer or suppressor. Currently, in order to use the same silencer on, for example, a 9 mm pistol and 9 mm rifle (Pistol Caliber Carbine (PCC)), the muzzle booster would need to be unscrewed from the silencer and the suppressor coupled onto the rifle using a different adapter, or at the very least, the muzzle booster would need to be unscrewed from the pistol and re-screwed onto the rifle. This is time consuming and cumbersome. Further, muzzle boosters are typically not desirable to be used on a rifle, due to the rifle having no moving barrel and not needing the mass of the silencer to be absorbed. The booster, never the less, can be used on a rifle, such use is just not desirable.

There is a need in the industry for a muzzle booster and suppressor that can easily and quickly move between use on a pistol and pistol caliber carbine.

SUMMARY OF THE INVENTION

The various embodiments and examples of the present invention as presented herein are understood to be illustrative of the present invention and not restrictive thereof and are non-limiting with respect to the scope of the invention. The present invention provides a muzzle booster that is designed to be quick detaching/quick connecting on the suppressor mating end, rather than threaded traditionally. Further, the spring is now retained by a standalone piston nut, and a conventional booster housing of the prior art designs is replaced by a booster slide, wherein the booster slide has lugs on the outside to create a quick detach system.

The present invention provides a quick coupling muzzle booster and suppressor adaptor system having a quick coupling muzzle booster and suppressor adaptor and rifle adaptor that can be coupled to a suppressor and mounted on a lock breech pistol or pistol caliber carbine. The quick coupling muzzle booster and suppressor adaptor system according to the invention provides wherein the quick coupling muzzle booster includes a booster slide with an external quick connect for coupling to the suppressor adaptor, and wherein the external quick connect of the booster slide includes a plurality of lugs corresponding to a proximal end of a housing of the suppressor coupling, and wherein the muzzle booster includes a booster piston that is coupled to a pistol. The quick coupling muzzle booster and suppressor adaptor system according to the invention may provide wherein the muzzle booster includes a booster piston nut with a spring, wherein the booster piston nut is coupled to the booster piston, and wherein the muzzle booster acts as what has been referenced as a linear inertia decoupler for a lock breech pistol.

These and other advantages of the present invention are described below in connection with the attached figures in which like reference numerals represent like elements throughout.

BRIEF DESCRIPTION OF THE FIGURES

FIG. 1 is a schematic side elevation view of a quick coupling muzzle booster and suppressor adaptor system and suppressor mounted on a lock breech pistol according to one embodiment of the present invention.

FIG. 2 is a schematic side elevation view of the quick coupling suppressor adaptor and suppressor of FIG. 1 mounted on a pistol caliber carbine according to one embodiment of the present invention.

FIG. 3 is a schematic perspective view of the quick coupling muzzle booster and suppressor adaptor system of FIG. 1.

FIG. 4 is a schematic front end view of the quick coupling muzzle booster and suppressor adaptor system of FIG. 1.

FIG. 5 is a sectional view of the quick coupling muzzle booster and suppressor adaptor system of FIG. 1 taken along the section line A-A of FIG. 4.

FIG. 6 is a schematic perspective view of the quick coupling suppressor adaptor of FIG. 1.

FIG. 7 is a schematic front end view of the quick coupling suppressor adaptor of FIG. 1.

FIG. 8 is a sectional view of the quick coupling suppressor adaptor of FIG. 1 taken along the section line E-E of FIG. 7.

FIG. 9 is a schematic perspective view of the quick coupling muzzle booster of FIG. 1.

FIG. 10 is a schematic front end view of the quick coupling muzzle booster of FIG. 1.

FIG. 11 is a sectional view of the quick coupling muzzle booster of FIG. 1 taken along the section line B-B of FIG. 10.

FIG. 12 is a schematic perspective view of the quick coupling rifle adaptor of FIG. 2.

FIG. 13 is a schematic front end view of the quick coupling rifle adaptor of FIG. 2.

FIG. 14 is a sectional view of the quick coupling rifle adaptor of FIG. 2 taken along the section line G-G of FIG. 13.

BRIEF DESCRIPTION OF THE PREFERRED EMBODIMENT

The present invention provides a quick coupling muzzle booster and suppressor adaptor system with a muzzle booster 110 and a suppressor adaptor 140 and direct rifle mount 160 (or rifle adaptor 160) that can be coupled to a suppressor 100, wherein the system may be mounted on a lock breech pistol 10 as shown in FIG. 1 or pistol caliber carbine 20 as shown in FIG. 2.

As noted above, most pistols 10 made today are short recoil operated, also called locked-breech pistols. The short recoil action dominates the world of centerfire semi-automatic pistols, being found in nearly all weapons chambered for high-pressure pistol cartridges of 9×19 mm Parabellum and larger. These pistols 10 can more easily handle higher pressure cartridges because when the slide starts moving to the rear, the barrel moves with it.

Suppressors 100, also commonly referred to as "silencers" and sound moderators, are devices fixed to the end of a firearm such as pistol 10 and pistol caliber carbine 20, intended to muffle the sound of a shot being fired, and not to silence this sound. The suppressor 100 reduces the acoustic intensity of the muzzle report (i.e. sound of a gunshot) and the recoil when a gun 10 or 20 is discharged, by modulating the speed and pressure of the propellant gas from the muzzle and hence suppressing the muzzle blast. As noted above the sound of a gunshot from a gun with a suppressor is still loud, but is generally safe enough to avoid the operator from having to wear hearing protection (with the exception of some large calibers).

The silencer 100 may be generally conventional and be formed as a metallic (usually stainless steel or titanium) cylinder containing internal sound baffles, with a hollow bore to allow the projectile (bullet) to exit normally. During firing, the bullet flies through the bore with little hindrance, but most of the expanding gas ejecta behind it is retained through a longer and convoluted escape path created by the baffles, prolonging the release time. This slows down the gas and dissipates its kinetic energy into a larger surface area, reducing the blast intensity, thus lowering the loudness. The silencer 100, as is common in the art, is a detachable accessory and is mounted to suppressor adaptor 140 in the present invention as discussed below.

Pistol-Caliber Carbines 20, also known as PCCs, are shoulder-mounted long guns that are chambered in a pistol cartridge, such as 9 mm. Pistol-Caliber Carbines 20 are considered one of the best, most versatile firearm platforms available offering increased accuracy and terminal performance of a long gun with the reduced recoil of handgun rounds.

The suppressor adaptor 140 is shown in FIGS. 3-5 coupled with the muzzle booster 110 of the invention and individually in FIGS. 6-8. The suppressor adaptor 140 is formed as a three lug adaptor. The suppressor adaptor 140 could easily be formed with four or more lugs if desired. This style of adaptor is to be available from Jenmach under the J-LUG™ brand, and is expected to be useful for rapid attachment of any barrel mounted gun accessory, like a muzzle brake, flash suppressor or the like.

The suppressor adaptor 140 includes a lug housing 142 which includes a suppressor attaching device such as external threads (not shown) on the distal end (farther from the muzzle of the gun 10 or 20) of the housing 142 that the suppressor 100 is threaded onto. Alternative suppressor couplings are possible, but threading is likely most common. The suppressor adaptor 140 will have threads matching a given set of suppressors 100 and different thread sizes may be provided via distinct housings to accommodate a range of suppressors 100. The user would obtain the suppressor adaptor with threads matching his particular suppressor.

The proximal end of the housing 142 includes three lug receiving openings and three lug retaining members that correspond to lugs on the muzzle booster 110 discussed below. Each lug retaining member will have a pocket or recess configured to receive a lug therein.

The suppressor adaptor 140 includes a lug piston 146 and a lug screw 144 with a spring 148 to bias the components into a locking position. The lug screw 144 is coupled to the housing 142 by threads.

The muzzle booster 110 is shown in FIGS. 3-5 coupled with the suppressor adaptor 140 of the invention and is shown individually in FIGS. 9-11. The muzzle booster 110 includes a booster slide 112. The booster slide 112 includes three lugs corresponding to the proximal end of the housing 142 and the three lug receiving openings and three lug retaining members. The lugs on the booster slide 112 allow for quick coupling of the suppressor adaptor 140 of the invention and the muzzle booster 110.

The muzzle booster 110 includes a booster piston 116 that is coupled to a pistol 10 in a conventional fashion, typically a threaded connection. The muzzle booster 110 includes a booster piston nut 114 with a spring 118. The booster piston nut 114 is coupled to booster piston 116 such as by threads. In an alternative configuration the booster piston 116 is minimized to accommodate a larger spring 118 and it is possible to construct the booster 110 without the slide extending down to the piston nut 114 to increase the space for a larger spring 118, however the preferred configuration is illustrated.

In operation with pistol 10, the suppressor adaptor 140 is coupled to the suppressor 100 and the muzzle booster 110 is coupled to the gun 10, both generally threaded couplings. The suppressor adaptor 140 is then coupled to the muzzle booster through the engagement of the proximal end of the housing 142 and the booster slide 112. In operation the muzzle booster 110 acts in a conventional fashion, in other words this may be referenced as the muzzle booster 110 acts as a mass absorber or what has been described as a "linear inertia decoupler" that decouples the mass of the suppressor 100 from the cycling action of the gun 10 via the booster slide 112 action.

The rifle direct mount or rifle adaptor 160 is shown in FIGS. 12-14. The proximal end of the rifle direct mount 160 is includes an exterior surface matching the configuration of the exterior of the booster slide 112 and the mount 160 includes three lugs corresponding to the proximal end of the housing 142 and the three lug receiving openings and three lug retaining members. The proximal end of the rifle direct mount 160 is includes an interior surface matching the configuration of the interior of the booster piston 116 and will includes threads for coupling to the barrel of the PCC 20. The distal end of the rifle direct mount 160 includes an integral muzzle brake or recoil compensator. A recoil compensator is a device connected to the muzzle or barrel of a firearm that is intended to redirect a portion of propellant gases to counter recoil and unwanted muzzle rise. A muzzle brake may also be integral to a gun barrel in configurations not relevant for the present invention.

When the user desires to use the suppressor 100 with a pistol caliber carbine 20 as shown in FIG. 2 the user need only use the quick coupling of the suppressor adaptor 140 to decouple the suppressor and adaptor 140 from the muzzle booster 110. The rifle direct mount 160 is coupled or threaded to the pistol caliber carbine 20. The user will couple the adaptor 140 and suppressor 100 to the rifle direct mount 160 on the pistol caliber carbine 20. In practice the muzzle booster 110 generally remains coupled to the pistol 10 and the rifle direct mount 160 remains coupled to the pistol caliber carbine 20 allowing the user to rapidly switch the suppressor between the two with ease.

The above description is representative of the present invention but not restrictive thereof. The full scope of the present invention are set forth in the appended claims and equivalents thereto.

What is claimed is:

1. A quick coupling suppressor adaptor system, comprising: a quick coupling muzzle booster including a lock breech pistol coupling configured to be mounted on a lock breech pistol barrel; a direct rifle mount including a pistol caliber carbine coupling configured to be mounted to a pistol caliber carbine, each of the quick coupling muzzle booster and the direct rifle mount having an outer surface with a suppressor adaptor coupling; a suppressor adaptor having a suppressor adaptor outer surface including a suppressor coupling configured to be coupled to a suppressor and a suppressor adaptor inner surface with a complementary adaptor coupling to engage the suppressor adaptor coupling to selectively mount the suppressor adaptor to the quick coupling muzzle booster or the direct rifle mount.

2. The quick coupling suppressor adaptor system according to claim 1 wherein the quick coupling muzzle booster includes a booster slide with the suppressor adaptor coupling thereon comprising an external quick connect for coupling to the suppressor adaptor.

3. The quick coupling suppressor adaptor system according to claim 2 wherein the external quick connect of the booster slide includes a plurality of lugs corresponding to a proximal end of a housing of the suppressor coupling.

4. The quick coupling suppressor adaptor system according to claim 3 wherein the external quick connect of the booster slide includes three lugs corresponding to the proximal end of the housing.

5. The quick coupling suppressor adaptor system according to claim 3 wherein the muzzle booster includes a booster piston including the lock breech pistol coupling that is coupled to a pistol.

6. The quick coupling suppressor adaptor system according to claim 5 wherein the lock breech pistol coupling of the booster piston is threaded to the pistol.

7. The quick coupling suppressor adaptor system according to claim 5 wherein the muzzle booster includes a booster piston nut with a spring, wherein the booster piston nut is coupled to the booster piston, and wherein the muzzle booster acts as a linear inertia decoupler for a lock breech pistol.

8. The quick coupling suppressor adaptor system according to claim 7 wherein the booster piston nut is threaded to booster piston.

9. The quick coupling suppressor adaptor system according to claim 5 wherein the suppressor adaptor coupling includes a plurality of lugs.

10. The quick coupling suppressor adaptor system according to claim 9 wherein the suppressor adaptor coupling is formed as a three lug J-lug adaptor.

11. The quick coupling suppressor adaptor system according to claim 5 wherein the suppressor adaptor coupling of the direct rifle mount includes an exterior surface on one end matching the configuration of the exterior of the external quick connect of the booster slide.

12. The quick coupling suppressor adaptor system according to claim 5 wherein the suppressor adaptor coupling of the direct rifle mount includes a plurality of lugs corresponding to a proximal end of the suppressor adaptor.

13. The quick coupling suppressor adaptor system according to claim 5 wherein the direct rifle mount includes an interior surface matching the configuration of an interior of the booster piston.

14. The quick coupling suppressor adaptor system according to claim 5 wherein the direct rifle mount includes integral muzzle brake.

15. A suppressor system comprising: a suppressor; and a quick coupling suppressor adaptor system, the adaptor system having a quick coupling muzzle booster including a lock breech pistol coupling configured to be mounted on a lock breech pistol barrel; a direct rifle mount including a pistol caliber carbine coupling configured to be mounted to a pistol caliber carbine, each of the quick coupling muzzle booster and the direct rifle mount having an outer surface with a suppressor adaptor coupling; a suppressor adaptor having a suppressor adaptor outer surface including a suppressor coupling configured to be coupled to a suppressor and a suppressor adaptor inner surface with a complementary adaptor coupling to engage the suppressor adaptor coupling to selectively mount the suppressor adaptor to the quick coupling muzzle booster or the direct rifle mount.

16. The suppressor system according to claim 15 wherein the quick coupling muzzle booster includes a booster slide with the suppressor adaptor coupling thereon comprising an external quick connect for coupling to the suppressor adaptor.

17. The suppressor system according to claim 16 wherein the muzzle booster includes a booster piston including the lock breech pistol coupling that is coupled to a pistol.

18. The suppressor system according to claim 17 wherein the muzzle booster includes a booster piston nut with a spring, wherein the booster piston nut is coupled to the booster piston, and wherein the muzzle booster acts as a linear inertia decoupler for a lock breech pistol.

19. The suppressor system according to claim 18 wherein the suppressor adaptor coupling of the direct rifle mount includes an exterior surface on one end matching the configuration of the exterior of the external quick connect of the booster slide.

20. The suppressor system according to claim 19 wherein the direct rifle mount includes an integral muzzle brake.

* * * * *